US008308084B2

(12) United States Patent
Peng

(10) Patent No.: US 8,308,084 B2
(45) Date of Patent: Nov. 13, 2012

(54) WATER SPRAY STRUCTURE

(75) Inventor: Ke Sheng Peng, Fujian (CN)

(73) Assignee: Xiamen Runner Industrial Corporation, Fujian (CN)

( * ) Notice: Subject to any disclaimer, the term of this patent is extended or adjusted under 35 U.S.C. 154(b) by 299 days.

(21) Appl. No.: 12/880,140

(22) Filed: Sep. 12, 2010

(65) Prior Publication Data

US 2012/0061492 A1 Mar. 15, 2012

(30) Foreign Application Priority Data

Sep. 15, 2009 (CN) ..... 2009 2 0182996 U

(51) Int. Cl.
*E03C 1/08* (2006.01)

(52) U.S. Cl. ..... 239/428.5; 239/432

(58) Field of Classification Search ..... 239/428.5, 239/432, 553.3, 554, 462, 424.5
See application file for complete search history.

(56) References Cited

U.S. PATENT DOCUMENTS 2,998,931 A * 9/1961 Aghnides ..... 239/428.5
3,130,917 A * 4/1964 Aghnides ..... 239/428.5
5,495,985 A * 3/1996 Nehm et al. ..... 239/428.5
6,126,093 A * 10/2000 Grether et al. ..... 239/428.5
6,708,902 B2 * 3/2004 Takeshi et al. ..... 239/428.5

* cited by examiner

*Primary Examiner* — Davis Hwu

(57) ABSTRACT

A water spray structure includes an outer housing, an inner sleeve, a mesh member, a spray member and an end cap. The inner sleeve is located in the outer housing. A gap is defined between an outer wall of the inner sleeve and an inner wall of the outer housing. The inner sleeve has apertures thereon. The spray member is located in the inner sleeve and has a plurality of through holes around a circumferential portion thereof. Each of the through holes has a large upper part and a small lower part. The spray member has stop pieces under the through holes. The stop pieces are disposed in a tangent direction. A mixing chamber is defined between a lower end of the spray member and a lower portion of the inner sleeve. The spray member has the plurality of through holes disposed around the circumferential portion of the spray member, the inlets and the transversal inlets to separate water to flow in the through holes. The stop pieces are disposed under the through holes to disperse the water in a spiral form. The tapered through holes form a negative pressure in the spray member for mixing with the air so as to form oxygenated mist. The water stream becomes comfortable.

12 Claims, 5 Drawing Sheets

WATER SPRAY STRUCTURE

BACKGROUND OF THE INVENTION

1. Field of the Invention

The present invention relates to a water spray device, and more particularly to a water spray structure for a faucet.

2. Description of the Prior Art

In general, a water spray head is installed at the outlet of a faucet for providing soft and comfortable water stream which is in the form of bubble water or which is mixed with air so as to save water. A conventional water spray head is to separate water so as to provide fine water, which has a complicated structure, such as Chinese Patent No. 200320117436.6 owned by the applicant of the present invention. Wherein, the filter comprises a filtering basket, a single-layer mesh screen, a dual-layer mesh screen, a stainless steel mesh screen and other parts to form bubble water. The parts are complicated and its effect to soften water is achieved by the multiple mesh screens.

SUMMARY OF THE INVENTION

The primary object of the present invention is to provide a water spray structure which is simple and compact and provides soft and comfortable water.

According to the present invention, there is provided a water spray structure which comprises an outer housing, an inner sleeve, a mesh member, a spray member and an end cap. The inner sleeve is located in the outer housing. A gap is defined between an outer wall of the inner sleeve and an inner wall of the outer housing. The inner sleeve has apertures thereon. The spray member is located in the inner sleeve and has a plurality of through holes around a circumferential portion thereof. Each of the through holes has a large upper part and a small lower part. The spray member has stop pieces under the through holes. The stop pieces are disposed in a tangent direction. A mixing chamber is defined between a lower end of the spray member and a lower portion of the inner sleeve.

Preferably, a mesh screen member is provided in the inner sleeve.

Preferably, the mesh screen member is composed of an upper mesh screen and a lower mesh screen. The upper mesh screen has meshes which are larger than meshes of the lower mesh screen.

Preferably, the outer housing is a cylinder. The outer housing has an engaging groove on an outer wall at an upper end thereof and a first step on the inner wall close to the upper end. The inner sleeve is located on the first step.

Preferably, the inner sleeve is a cylinder. The inner sleeve has a flange corresponding to a first step of the outer housing at an upper end thereof. The inner sleeve has a plurality of spaced protruding ribs which are longitudinally disposed on the outer wall of the inner sleeve. The protruding ribs have an outer diameter smaller than an inner diameter of the outer housing. Each protruding rib is formed with the aperture at an upper end thereof. The aperture communicates with the inner sleeve.

Preferably, the inner sleeve has a second step on an inner wall thereof. The second step is located above the aperture and close to the upper end of the inner sleeve. The inner sleeve has a plurality of spaced guide grooves which are longitudinally disposed on the inner wall of the inner sleeve. The inner sleeve has a bottom surface which is a mesh surface.

Preferably, the upper and lower mesh screens have a plurality of protrusions around outer edges thereof. The protrusions correspond to a plurality of guide grooves of the inner sleeve. The protrusions of the upper mesh screen protrude from a lower surface of the upper mesh screen. A gap is formed between the upper mesh screen and the lower mesh screen.

Preferably, the spray member has a disc at a middle portion thereof to match with a second step of the inner sleeve. The disc has a plurality of through holes disposed around a circumferential portion thereof. The disc has a central hole. The central hole has a large upper part and a small lower part. The disc has a water inlet seat at an upper section thereof. The water inlet seat is longitudinally formed with a plurality of inlets which are disposed around a circumferential portion of the water inlet seat. The inlets correspond in position to the through holes. The water inlet seat has transversal inlets corresponding to and communicating with the inlets.

Preferably, each of the stop pieces has an outer end overlapped with an inner end of another adjacent stop piece. A water passage is defined between every two of the adjacent stop pieces.

Preferably, the water inlet seat has a raised rim around an upper edge to position the end cap on the water inlet seat.

Accordingly, the water spray structure of the present invention provides the mixing chamber formed between the spray member and the inner sleeve, the air passage formed between the inner sleeve and the outer housing, the plurality of through holes disposed around the circumferential portion of the spray member, the inlets with the transversal inlets to separate water to flow in the through holes, the stop pieces disposed under the through holes to disperse the water in a spiral form, the tapered through holes to form a negative pressure in the spray member for mixing with the air so as to form oxygenated mist. The water stream becomes comfortable and the water flow becomes smaller so as to save water. Compared to the prior art which needs a multi-layer mesh screen, the water spray structure of the present invention is simple and compact in structure and provides soft and comfortable water stream.

DETAILED DESCRIPTION OF THE PREFERRED EMBODIMENTS

Embodiments of the present invention will now be described, by way of example only, with reference to the accompanying drawings.

Figure 1:
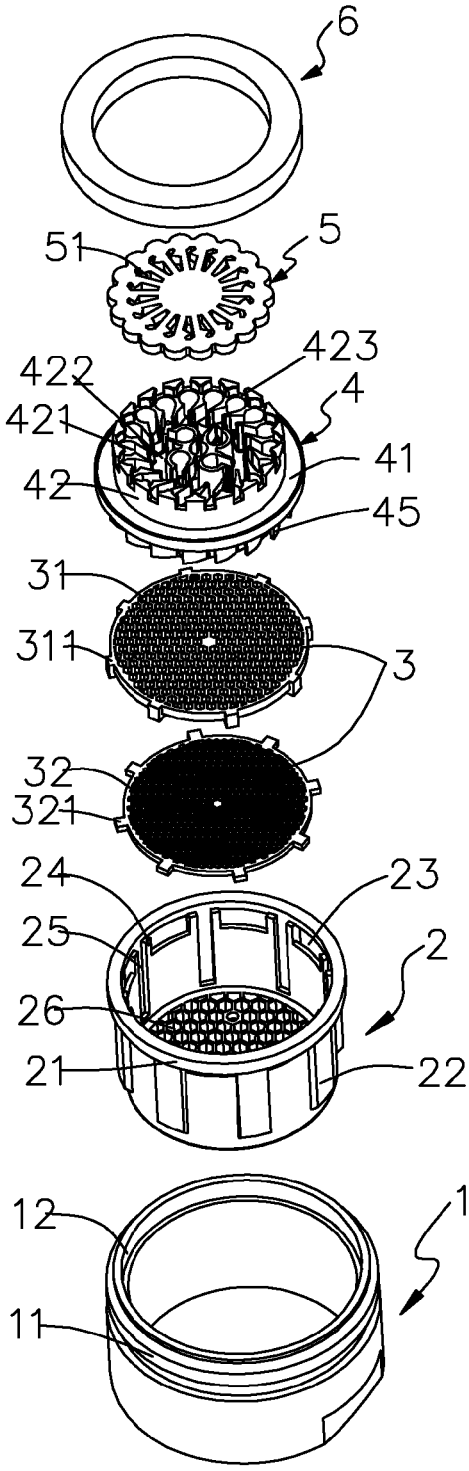
FIG. 1 is an exploded view according to a preferred embodiment of the present invention.
Figure 2A:
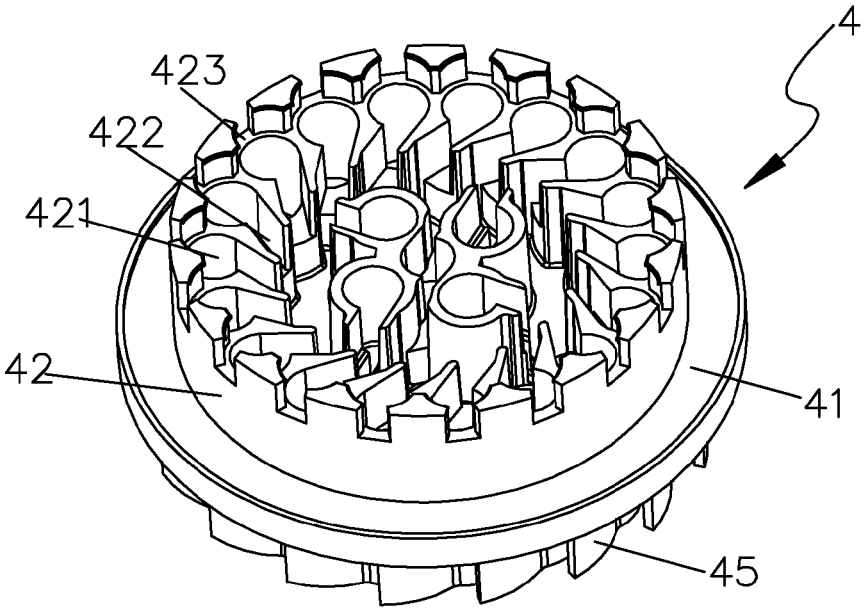
FIG. 2A is a front perspective view according to the preferred embodiment of the present invention.
Figure 2B:
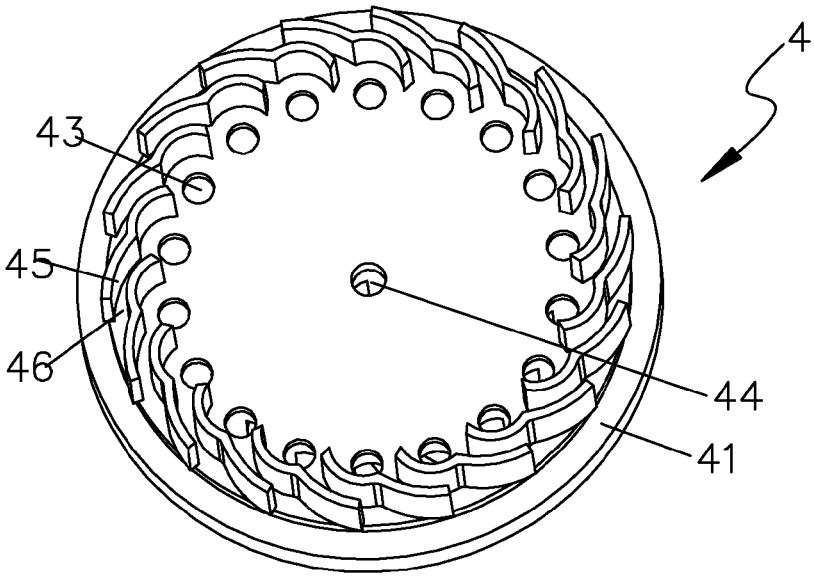
FIG. 2B is a rear perspective view according to the preferred embodiment of the present invention.
Figure 3:
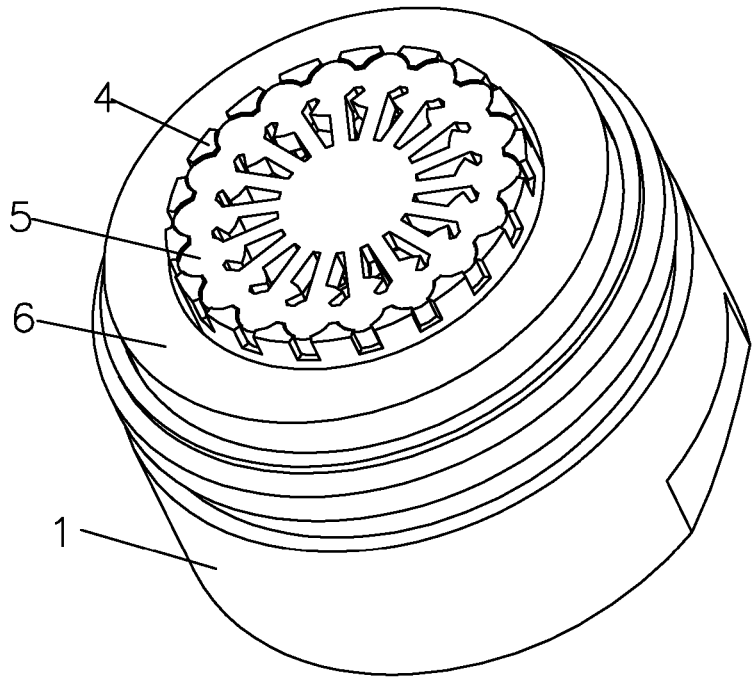
FIG. 3 is a perspective view according to the preferred embodiment of the present invention.
Figure 4:
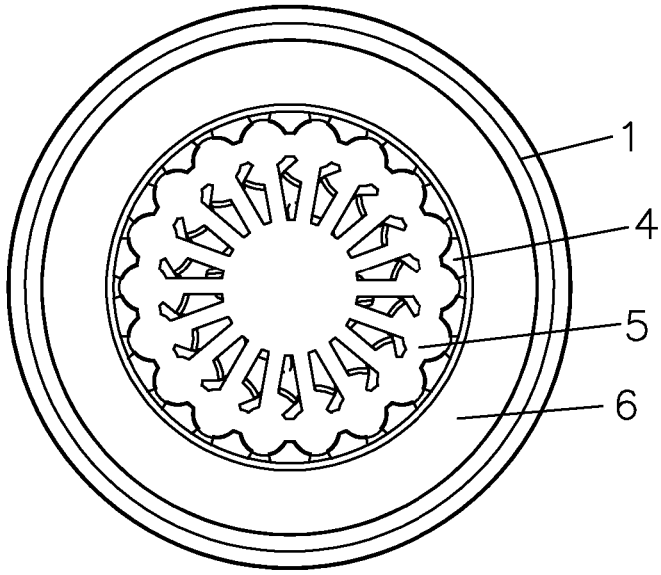
FIG. 4 is a top view according to the preferred embodiment of the present invention.
Figure 5:
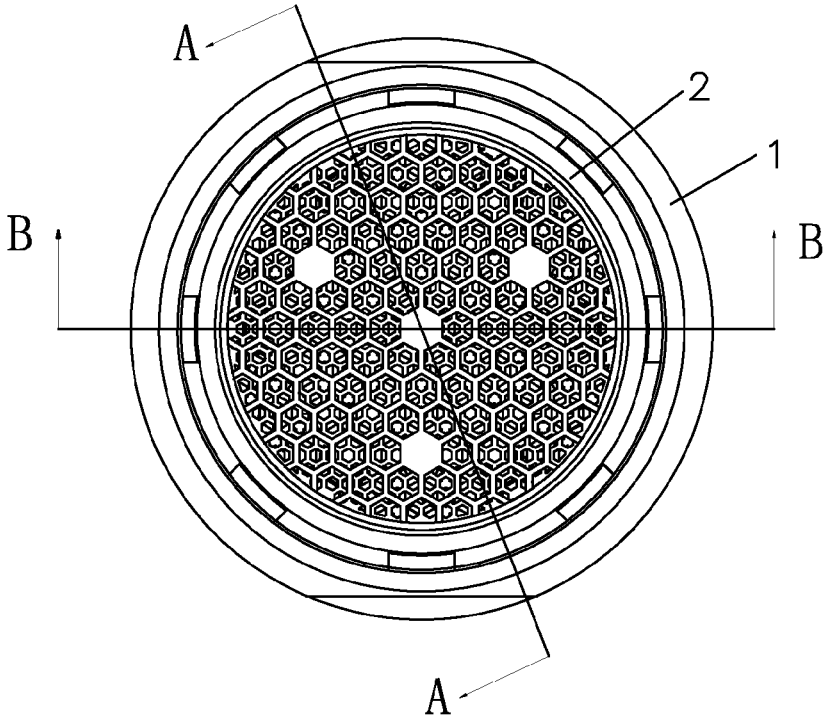
FIG. 5 is a bottom view according to the preferred embodiment of the present invention.
Figure 6:
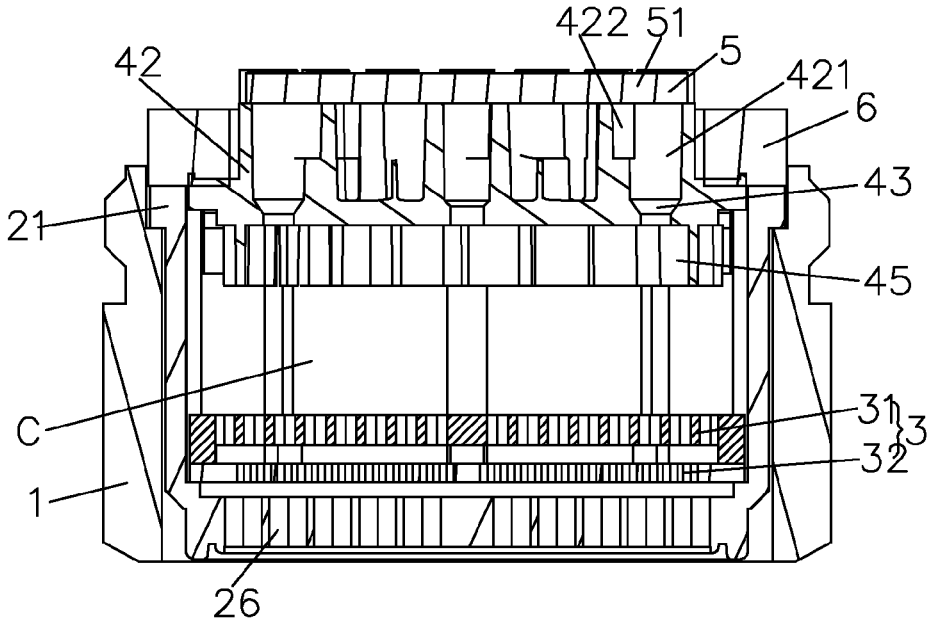
FIG. 6 is a cross-sectional view taken from line A-A of FIG. 5.
Figure 7:
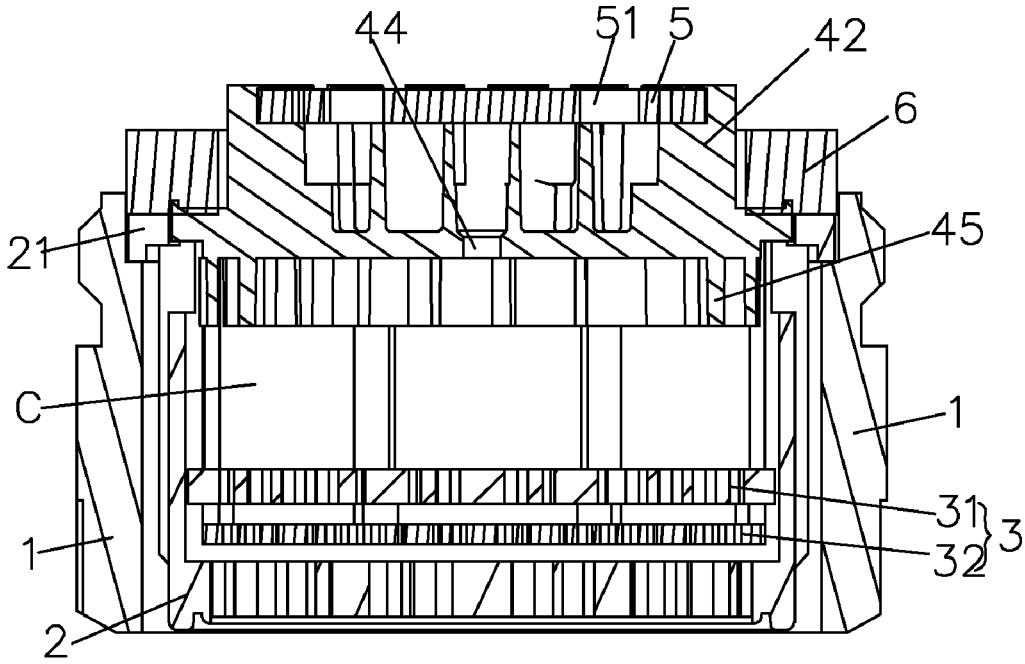
FIG. 7 is a cross-sectional view taken from line B-B of FIG. 5.

As shown in FIG. 2 and FIG. 3, a water spray structure according to a preferred embodiment of the present invention comprises an outer housing 1, an inner sleeve 2, a mesh member 3, a spray member 4, and an end cap 5.

The outer housing 1 is a cylinder. The outer housing 1 has an engaging groove 11 on an outer wall of an upper end thereof and a first step 12 on an inner wall of the upper end. The engaging groove 11 is sealed and fixed in a faucet. The inner sleeve 2 is located on the first step 12.

The inner sleeve 2 is also a cylinder. The inner sleeve 2 has a flange 21 corresponding to the first step 12 of the outer housing 1 at an upper end thereof. The inner sleeve 2 has a plurality of spaced protruding ribs 22 which are longitudinally disposed on an outer wall of the inner sleeve 2. The protruding ribs 22 have an outer diameter smaller than an inner diameter of the outer housing 1. Each protruding rib 22 is formed with an aperture 23 at an upper end thereof. The aperture 23 communicates with the inner sleeve 2. The inner sleeve 2 has a second step 24 on an inner wall thereof. The second step 24 is located above the aperture 23 and close to the upper end of the inner sleeve 2. The inner sleeve 2 has a plurality of spaced guide grooves 25 which are longitudinally disposed on the inner wall of the inner sleeve 2. The inner sleeve 2 has a bottom surface which is a mesh surface 26.

The mesh screen member 3 is composed of two mesh screens, an upper mesh screen 31 and a lower mesh screen 32. The upper mesh screen 31 has meshes which are larger than meshes of the lower mesh screen 32. The upper and lower mesh screens 31, 32 have a plurality of protrusions 311, 321 around outer edges thereof. The protrusions 311, 321 correspond to the plurality of guide grooves 25 of the inner sleeve 2, so that the upper and lower mesh screens 311, 321 can be positioned in the inner sleeve 2. The protrusions 311 of the upper mesh screen 31 protrude from a lower surface of the upper mesh screen 31 so that a gap formed between the upper mesh screen 31 and the lower mesh screen 32.

Referring to FIG. 2A and FIG. 2B, the spray member 4 has a disc 41 at a middle portion thereof to match with the second step 24 of the inner sleeve 2. The disc 41 has a plurality of through holes 43 disposed around a circumferential portion thereof. Each through holes 43 has a large upper part and a small lower part. The disc 41 further has a central hole 44. The central hole 44 also has a large upper part and a small lower part. The disc 41 has a water inlet seat 42 at an upper section thereof. The water inlet seat 42 is longitudinally formed with a plurality of inlets 421 which are disposed around a circumferential portion of the water inlet seat 42. The inlets 421 correspond in position to the through holes 43. The water inlet seat 42 has transversal inlets 422 corresponding to and communicating with the inlets 421. The water inlet seat 42 has a raised rim 423 around an upper edge to position the end cap 5 on the water inlet seat 42. The disc 41 includes a plurality of stop pieces 45 extending from a bottom of the disc 41. The stop pieces 34 correspond in position to the through holes 43 and are disposed in a tangent direction. An outer end of one stop piece 34 is overlapped with an inner end of another adjacent stop piece 34, such that a water passage 46 is formed between every two adjacent stop pieces 45.

The end cap 5 is adapted to cover the water inlet seat 42. The end cap 5 has a plurality of inlet holes 51 corresponding to the transversal inlets 422.

To assembly the present invention, referring to FIG. 3 to FIG. 7, the mesh screen member 3 is placed in the inner sleeve 2, with the protrusions 311, 321 of the upper and lower mesh screens 31, 32 to engage with the guide grooves 25 of the inner sleeve 2. After that, the spray member 4 is placed in the inner sleeve 2, with the outer edge of the disc 41 to lean against the second step 24. A mixing chamber C is formed between the lower section of the spray member 4 and the mesh screen member 3. The end cap 5 is to cover the water inlet seat 42 of the spray member 4, with the raised rim 423 to confine the end cap 5. The inner sleeve 2 with the mesh screen member 3, the spray member 4 and the end cap 5 is placed in the outer housing 1. A rubber washer 6 is fitted on the upper edge of the spray member 4. The lower part of the rubber washer 6 is embedded in the outer housing 1 so as to seal the faucet.

When in use, the assembled water spray structure of the present invention is installed at the outlet of a water source device. When the water source device is turned on, the water flows through the inlet holes 51 of the end cap 5 to the transversal inlets 422 and the inlets 421 of the spray member 4 and then into the through holes 43. Because the water flowing into the inlets 421 is from the transversal inlets 422, subject to the water pressure, the water to flow into the through holes 43 is in a spiral form to spray mist. The water flowing out of the through holes 43 will be restricted by the stop pieces 45 and pass the water passage 46 to be spiraled again. Because each through hole 43 is a tapered hole, in accordance with the principle of venture tube, the mixing chamber C formed between the spray member 4 and the mesh screen member 3 will form a negative pressure, the air will enter from the gap between the outer housing 1 and the inner sleeve 2 through the apertures 23 of the inner sleeve 2 to the mixing chamber C for mixing with the water to form oxygenated water. The water from the through holes 43 is distributed through the meshes of the upper and lower mesh screens 31, 32 and flows out from the mesh surface 26, so that the water flowing through the water spray structure will be fine and have more oxygen for a comfortable contact. The central hole 44 of the spray member 4 is adapted to add the water stream at the center of the spray member 4 because most water stream flows out from the through holes 43 in a spiral form and the water stream at the center of the spray member 4 may be insufficient.

Accordingly, the water spray structure of the present invention provides the mixing chamber C formed between the spray member 4 and the inner sleeve 2, the air passage formed between the inner sleeve 2 and the outer housing 1, the plurality of through holes 43 disposed around the circumferential portion of the spray member 4, the inlets 421 with the transversal inlets 422 to separate water to flow in the through holes 43, the stop pieces 45 disposed under the through holes 43 to disperse the water in a spiral form, the tapered through holes 43 to form a negative pressure in the spray member 4 for mixing with the air so as to form oxygenated mist. The water stream becomes comfortable and the water flow becomes smaller so as to save water. Compared to the prior art which needs a multi-layer mesh screen, the water spray structure of the present invention is simple and compact in structure and provides soft and comfortable water stream.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A water spray structure, comprising an outer housing, an inner sleeve, a mesh member, a spray member and an end cap, the inner sleeve being located in the outer housing, a gap defined between an outer wall of the inner sleeve and an inner wall of the outer housing, the inner sleeve having apertures thereon, the spray member being located in the inner sleeve and having a plurality of through holes around a circumferential portion thereof, each of the through holes having a large upper part and a small lower part, the spray member having stop pieces under the through holes, the stop pieces each being disposed in a tangent direction, a mixing chamber defined between a lower end of the spray member and a lower portion of the inner sleeve.

2. The water spray structure as claimed in claim 1, wherein a mesh screen member is provided in the inner sleeve.

3. The water spray structure as claimed in claim 2, wherein the mesh screen member is composed of an upper mesh screen and a lower mesh screen, the upper mesh screen having meshes which are larger than meshes of the lower mesh screen.

4. The water spray structure as claimed in claim 1, wherein each of the stop pieces has an outer end overlapped with an inner end of another adjacent stop piece, a water passage defined between every two of the adjacent stop pieces.

5. The water spray structure as claimed in claim 1, wherein the inner sleeve is a cylinder, the inner sleeve having a flange corresponding to a first step of the outer housing at an upper end thereof, the inner sleeve having a plurality of spaced protruding ribs which are longitudinally disposed on the outer wall of the inner sleeve, the protruding ribs having an outer diameter smaller than an inner diameter of the outer housing, each of the protruding ribs being formed with the aperture at an upper end thereof, the aperture communicating with the inner sleeve.

6. The water spray structure as claimed in claim 1, wherein the outer housing is a cylinder, the outer housing having an engaging groove on an outer wall at an upper end thereof and a first step on the inner wall close to the upper end, the inner sleeve being located on the first step.

7. The water spray structure as claimed in claim 6, wherein the inner sleeve is a cylinder, the inner sleeve having a flange corresponding to a first step of the outer housing at an upper end thereof, the inner sleeve having a plurality of spaced protruding ribs which are longitudinally disposed on the outer wall of the inner sleeve, the protruding ribs having an outer diameter smaller than an inner diameter of the outer housing, each protruding rib being formed with the aperture at an upper end thereof, the aperture communicating with the inner sleeve.

8. The water spray structure as claimed in claim 7, wherein the inner sleeve has a second step on an inner wall thereof, the second step being located above the aperture and close to the upper end of the inner sleeve, the inner sleeve having a plurality of spaced guide grooves which are longitudinally disposed on the inner wall of the inner sleeve, the inner sleeve having a bottom surface which is a mesh surface.

9. The water spray structure as claimed in claim 3, wherein the upper and lower mesh screens have a plurality of protrusions around outer edges thereof, the protrusions corresponding to a plurality of guide grooves of the inner sleeve, the protrusions of the upper mesh screen protruding from a lower surface of the upper mesh screen, a gap formed between the upper mesh screen and the lower mesh screen.

10. The water spray structure as claimed in claim 1, wherein the spray member has a disc at a middle portion thereof to match with a second step of the inner sleeve, the disc having a plurality of through holes disposed around a circumferential portion thereof, the disc having a central hole, the central hole having a large upper part and a small lower part, the disc having a water inlet seat at an upper section thereof, the water inlet seat being longitudinally formed with a plurality of inlets which are disposed around a circumferential portion of the water inlet seat, the inlets corresponding in position to the through holes, the water inlet seat having transversal inlets corresponding to and communicating with the inlets.

11. The water spray structure as claimed in claim 10, wherein each of the stop pieces has an outer end overlapped with an inner end of another adjacent stop piece, a water passage defined between every two of the adjacent stop pieces.

12. The water spray structure as claimed in claim 10, wherein the water inlet seat has a raised rim around an upper edge to position the end cap on the water inlet seat.

* * * * *